United States Patent [19]

Hesselmann et al.

[11] 4,310,576

[45] Jan. 12, 1982

[54] ADHESIVE-APPLYING APPARATUS AND METHOD

[75] Inventors: Karlheinz Hesselmann, Au bei Bad Aibling; Bernhard Tschiers; Ludwig Ertl, both of Rosenheim, all of Fed. Rep. of Germany

[73] Assignee: Planatolwerk W. Hesselmann, Chemische und Maschinenfabrik für Klebetechnik, Thansau, Fed. Rep. of Germany

[21] Appl. No.: 156,406

[22] Filed: Jun. 4, 1980

[30] Foreign Application Priority Data

Jun. 6, 1979 [DE] Fed. Rep. of Germany ..... 2922978

[51] Int. Cl.[3] ..... B05D 1/28; B05C 1/08

[52] U.S. Cl. ..... 427/428; 11/1 AD; 118/673; 118/677; 118/680; 118/210; 118/240; 118/244

[58] Field of Search ..... 427/428; 118/673, 677, 118/680, 706, 210, 240, 244, 261, 262; 11/1 AD

[56] References Cited

U.S. PATENT DOCUMENTS

| | | | |
|---|---|---|---|
| 998,221 | 7/1911 | Wheeler | 118/261 X |
| 2,141,978 | 12/1938 | Greenhill | 118/261 X |
| 3,672,326 | 6/1972 | Schulze | 118/680 |
| 3,866,568 | 2/1975 | Minami | 118/244 X |

*Primary Examiner*—Shrive P. Beck
*Attorney, Agent, or Firm*—Karl F. Ross

[57] ABSTRACT

A method of and an apparatus for coating flowable and pasty materials onto a workpiece, especially for the application of glue and other adhesive substances to the backs of signatures in book binding and the like, uses a rotating roller for applying the material which is partly immersed in a bath thereof and a reversible drive for the roller such that initially the roller is rotated in the direction of movement of the workpiece so as to pick up a thin layer of the material and, as the leading edge of the workpiece reaches the point at which material application commences, the direction of rotation is reversed while the workpiece continues its travel, thereby applying material in a uniform coating without the formation of a glob at the leading edge of the workpiece. Within the reservoir there is provided a dosing chamber having a pair of edges defining gaps with the roller, the upper gap being wider than the lower gap.

9 Claims, 3 Drawing Figures

ADHESIVE-APPLYING APPARATUS AND METHOD

FIELD OF THE INVENTION

Our present invention relates to a method of and an apparatus for applying flowable liquid or pasty substances to a workpiece and, more particularly, to a method of and an apparatus for applying glue or other adhesive substances to the back of a stack of sheets, e.g. signatures, adapted to form a pad, book, or folio alone or in conjunction with a binding.

BACKGROUND OF THE INVENTION

In the application of glue and like viscous adhesives to the back of a stack of sheets or leaves or signatures in pad, book or folio binding, it is a common practice to use a roller-type adhesive applicator in which the roller is rotated in a vessel constituting a reservoir for the adhesive and has its upper portion lying out of the bath and disposed to contact the underside of the stack which can be passed over the roller, as a workpiece, with the sheets or leaves in an upright position, i.e. on edge. The adhesive or glue is thus picked up by the periphery of the roller from the bath and transferred to the back of the stack as the latter is moved across the roller and the roller is rotated.

In general, one or more doctor blades may co-operate with the roller to control the thickness of the adhesive layer on the latter before it contacts the stack.

In earlier approaches utilizing this system, the roller was generally rotated in the direction of movement of the stack, i.e. its periphery, and the stack moved in the same direction at the region of contact.

The stack, generally gripped in a clamp device and guided by rails or the like along a linear or curved path, crossed the roller at the top thereof. The uniformity of the layer and the efficiency of transfer of the adhesive left much to be desired and subsequent systems utilized an opposite movement of the roller and the stack. In other words, as the stack was moved continuously in one direction across the top of the roller, the periphery of the roller was driven in the opposite direction at the top thereof.

This technique was found to improve the adhesive-transfer efficiency and the uniformity of the coating.

However, as the leading edge of the stack approaching or contacted the roller with the opposite movement described above of the roller and the stack, a glob of the adhesive tended to form on the leading edge, thereby destroying the uniformity of the coating and posing the danger that the adhesive would drip from the stack and create problems.

To avoid this difficulty, it has been proposed to suspend the adhesive-applying roller and the adhesive reservoir and to provide means for dropping the top of the roller by a distance approximately equal to the thickness of the adhesive layer on the roller at the moment the leading edge would otherwise contact the roller, thereafter raising the system to bring about the contact and application of the adhesive. This system was successful in preventing the formation of a glob of adhesive at the leading edge of the stack but involved the use of complex kinematics, movable adhesive-applying assemblies, as well as careful adjustment of the positions and movements of the latter. The system frequently went out of adjustment and was relatively expensive and often unreliable, especially where the mass which had to be moved was relatively large.

OBJECTS OF THE INVENTION

It is the principal object of our present invention to provide a method of applying an adhesive or like viscous liquid or pasty substance to a stack of sheets or signatures, or some other workpiece, whereby the disadvantages of earlier systems are obviated.

Another object of the invention is to provide an improved apparatus for the application of adhesive to sheet or signature stacks which will avoid the formation of globs on leading edges of the stacks and yet be free from the difficulties hitherto encountered with complex and sensitive kinematic systems for raising and lowering the adhesive-applying roller assemblies.

It is also an object of the invention to provide an improved method of operating a roller applicator for applying adhesives to a sheet or signature stack so that disadvantages of the prior systems are obviated.

Still a further object of the invention is to provide a method of and an apparatus for uniformly applying coatings, especially of pasty substances and viscous liquids, to a workpiece traveling past the applicator so that globs are not formed on the leading edge of the workpiece but without complicated and costly devices and without the need for repeated precision readjustment of the applicator.

SUMMARY OF THE INVENTION

These objects and others which will become apparent hereinafter are attained, in accordance with the present invention, by providing a reversible drive for the roller and rotating the roller in the direction of movement of the stack until the stack reaches the contact point whereby a layer of adhesive is picked up by the roller from the bath in the reservoir, and thereafter rotating the roller in the opposite direction while continuing the travel of the stack past the roller. This mode of operation, in conjunction with the provision of a dosing or metering compartment within the vessel and bath, preferably at the side of the roller downstream in the direction of movement of the stack from the point at which the stack contacts the roller, has been found to eliminate the formation of globs without requiring any displacement of the contact point of the roller, provided that the metering compartment defines with the periphery of the roller, two gap-like passages, the width of the upper passage being greater than the width of the lower passage or gap.

In the ensuing description, reference will repeatedly be made to an "adhesive" as the substance which is applied to the "stack" by the roller. While the method of the invention is particularly applicable to the formation of a layer of glue or like adhesive liquid to the back of a stack of leaves or signatures, it will be understood that the principles of our invention are also applicable to the coating of any viscous liquid or pasty substance upon any workpiece which can be moved past the applicator. The terms "adhesive" and "stack" should thus be understood to refer as well to such viscous or pasty liquids and to other workpieces, respectively.

The reversal in the rotation of the drum by the direction-reversing drive permits the optimum rotation for each stage of the adhesive pickup and applicator to be achieved. The drum thus rotates in the direction of the stack motion as the leading edge thereof approaches and if the adhesive is applied to the underside of the stack at the leading edge during this rotation in the same direction, no glob can form. Similarly, when the rotation of the roller is reversed, the leading edge passes the roller and any adhesive which might otherwise be expected to accumulate at the leding edge has previously been wiped from the roller onto the stack so that further movement of the stack past the roller produces counter-direction coating in the optimum manner.

In its method aspects, therefore, the invention provides for a feeding of the stack until the leading edge thereof reaches the adhesive-applying position while the roller is rotated in the same direction, whereupon the rotation of the roller is reversed while the movement of the stack is continued. It has been found to be advantageous to provide means, e.g. sensitive or limit switches, responsive to the leading and trailing ends of the stack for controlling the direction-reversal drive for the roller to permit operation in the described manner.

The metering chamber at the downstream side of the adhesive-application roller has been found necessary to ensure a uniform application of the coating substance to the roller when the rotation of the latter is reversed. Without this metering system, it should be clear, the thickness of the layer on the roller meeting the stack will vary because of the direction reversal.

Because the lower edge of the metering container defines a narrower gap with the roller than the upper edge, any excess on the roller periphery will be stripped during rotation of the roller in the direction of feed of the stack, i.e. with the condition which prevails between passage of the trailing edge of one stack and the approach of the leading edge of the next stack. However, the same relationship of gap widths permits a uniform layer to be applied when the roller rotation is reversed. The metering container, while being immersed in the reservoir or vessel for the adhesive, preferably has an overflow outlet for excess adhesive. The excess, carried in the direction of movement of the stack, is permitted to flow out through the overflow opening so that at the instant of rotation reversal the quantity of the substance in the container is practically fixed and is intensively transferred to the roller in a uniform manner. Generally the volume of the container should be at least equal to the volume applied to a given stack and is preferably several times greater than this volume.

It has also been found to be advantageous to provide on the upstream side of the applicator roller, a further layer-controlling or doctoring device, e.g. on ancillary roller, which is spaced from the applicator roller by a gap whose width is less than the upper gap width but greater than the lower gap width between the metering container and the applicator roller. This limits the quantity of the substance carried by the applicator roller as the latter meets the stack with codirectional motion. This doctoring device could also be an adjustably positionable rod although experience has shown that a cylindrical fixed rod will suffice for this purpose.

According to another feature of the invention, the upper edge of the metering container is disposed above the axis of the applicator roller and the normal adhesive level in the surrounding vessel. Thus the static pressure in the vessel has little effect if any upon the coating of the substance onto the roller. Furthermore, the substance in the metering container has its level significantly closer to the point of application, thereby eliminating any significant effect by evaporation of solvents, for example, prior to the application of the adhesive to the stack.

BRIEF DESCRIPTION OF THE DRAWING

The above and other features of our invention will become more readily apparent from the following description, reference being made to the accompanying drawing in which.

SPECIFIC DESCRIPTION

A stack 14 of sheets or signatures, clamped in any conventional manner and guided by rails or the like in a transport path across an applicator, is shown to be continuously movable in the direction represented by the arrow A across a rotatable adhesive-applying roller or drum 3.

The roller or drum 3 is partially immersed in adhesive in a vessel 1 from which adhesive is drawn to be deposited in a layer B on the underside C of the stack 14. Thus, the top of roller 3 lies just below the edge C forming the lower stack boundary.

Figure 3:
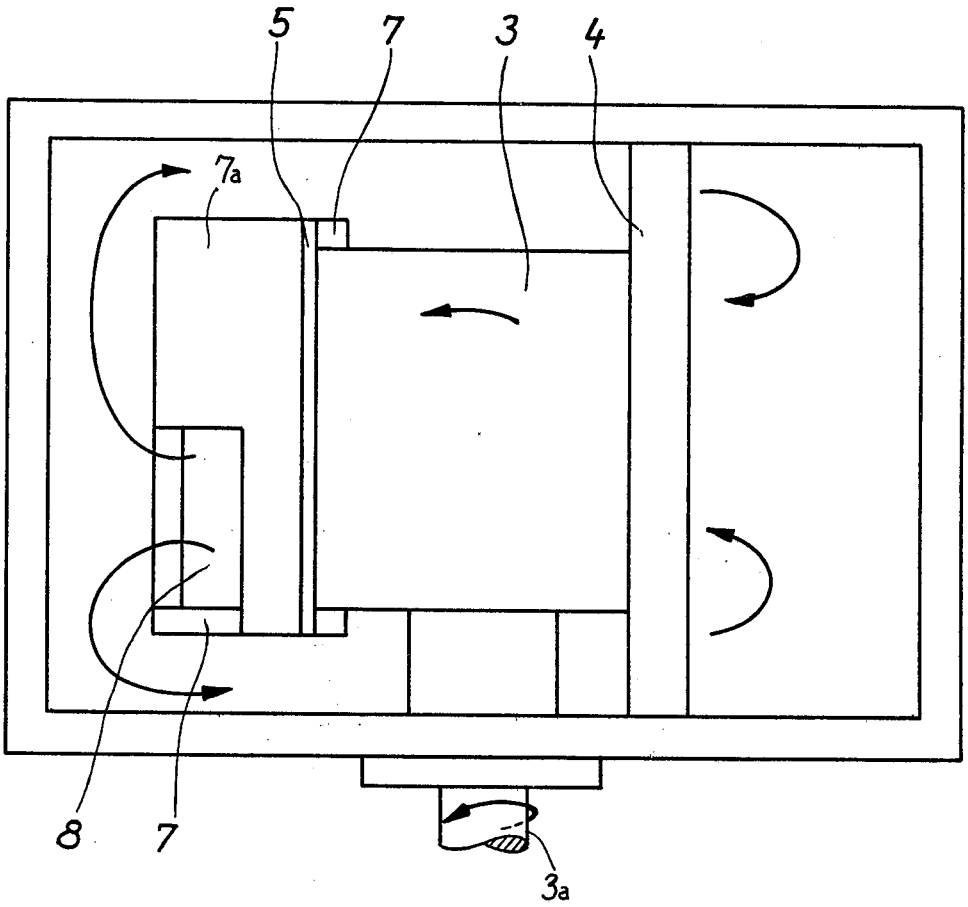
FIG. 3 is a plan view of the device shown in FIGS. 1 and 2.

Downstream of the roller 3, in the direction represented by arrow A, we provide within the vessel 1, a metering container 2 whose lateral walls 7 (FIG. 3) flank the ends of the roller 3 and sealingly separate the interior of the container from the adhesive in the vessel 1.

Upper and lower walls 7*a* and 7*b* of the container approach the roller 3 and have edges 5 and 6 which constitute doctor blades defining upper and lower clearances or gaps 11 and 10, respectively, with the roller 3.

The width of the upper gap 11 is greater than the width of the lower gap 10.

At the upstream side of the roller 3 we provide a doctoring rod 4 of cylindrical configuration above the level of the bath in the vessel 1, the gap 9 formed between this rod 4 and the roller 3 having a width smaller than that of the gap 11 but greater than that of gap 10.

The inner surface of the doctoring edge 5 is disposed above the axis of roller 3 and above the normal level of adhesive within the vessel 1. The upper wall 7*a* is also provided with an overflow opening 8 whereby excess adhesive in the container 2 can return to the vessel 1 (FIG. 1).

Figure 1:
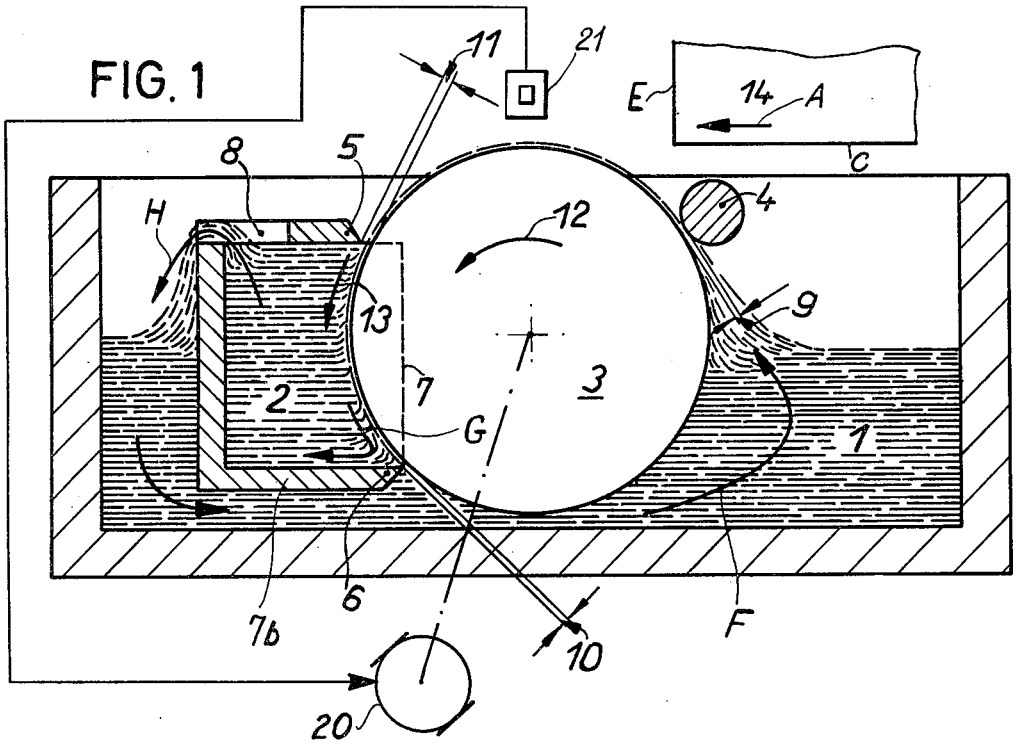
FIG. 1 is a diagrammatic longitudinal section through an adhesive applicator for sheet and signature stacks prior to commencement of coating.

The roller 3 has a shaft 3*a* which is connected to a reversible drive 20 controlled by a sensitive switch 21 which, as the leading edge or front E of the stack 14 reaches the top of the roller, reverses the sense of rotation of the roller 3; as the trailing edge of the stock passes the switch, the latter restores the original rotation as represented by the arrow 12 in FIG. 1.

In the position shown in FIG. 1, in which the workpiece 14 is still at a distance from the roller 3, the latter is driven in the counterclockwise direction so that its upper surface moves in the same direction as the stack (arrow A) as represented by the arrow 12.

During this rotation, a layer of adhesive is picked up by the roller, the thickness of the layer being controlled by the rod 4, as represented by the arrow F. The layer is carried into the container through the gap 11 (arrow 13), and any excess is accumulated in the container (arrow G) and passes through the sense (arrow 12*a*) as shown in FIG. 2.

Figure 2:
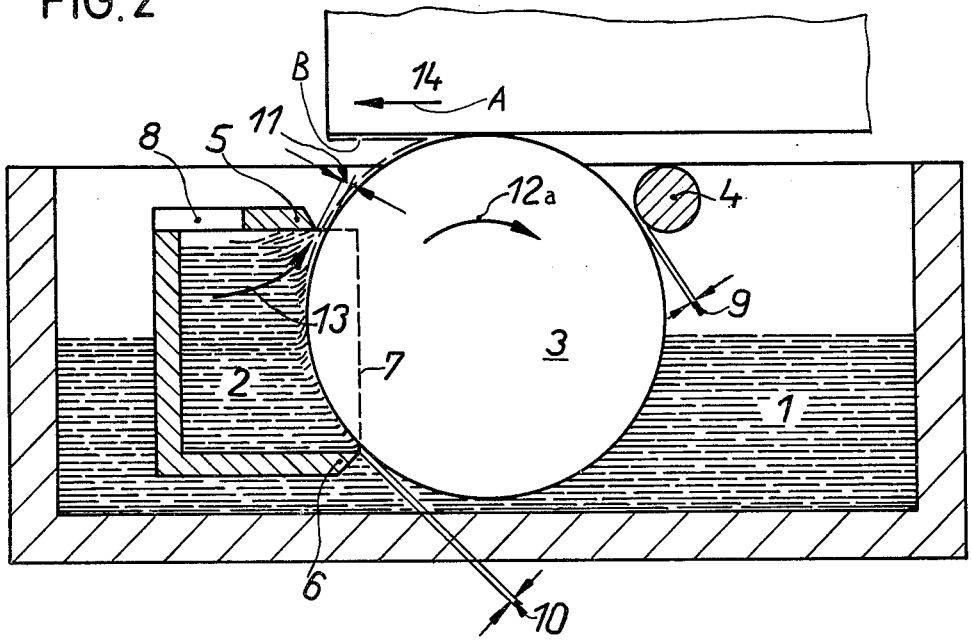
FIG. 2 is a view thereof showing the relationship of the parts during coating.

As soon as the stack 14 reaches the uppermost point of the roller 3 and passes thereover, the switch 21 reverses the sense of rotation so that the roller is now driven in the clockwise sense (arrow 12) as shown in FIG. 2).

In this rotational sense the adhesive is drawn from the container 2 which suffices to feed all that is required for the stack since its volume is generally several times greater than the volume required for a single stack. In this part of the process, the drum applies the adhesive in the direction counter to the direction of displacement of the stack 14, thereby achieving intensive and uniform coating. No glob is formed at the leading edge of the stack.

We claim:

1. An apparatus for applying a layer of a flowable substance to a workpiece, comprising:

a vessel containing a bath of said substance;

an applicator roller rotatable in said vessel and partially immersed in said bath and positioned so that said workpiece can be continuously displaced along a path in a given direction across said roller and meets the top of said roller to receive the substance from said roller;

reversing-drive means connected to said roller for rotating said roller in one sense upon approach of said workpiece to said roller whereby the upper portion of said roller moves in said direction, and in the opposite sense thereafter whereby said upper portion of said roller rotates in a direction opposite said given direction; and a metering container at a downstream side of said roller in said given direction, said metering container having upper and lower edges defining respective gaps with said roller, the upper gap being wider than the lower gap, the upper gap being disposed above the level of the bath in said vessel.

2. The apparatus defined in claim 1 wherein said edges are formed as doctor blades.

3. The apparatus defined in claim 1 wherein said container is provided with an overflow opening.

4. The apparatus defined in claim 1 wherein said container has a volume at least several times greater than the volume of said substance to be applied to said workpiece.

5. The apparatus defined in claim 1, further comprising a doctoring device disposed upstream of said roller with respect to said given direction and defining a gap with said roller which has a width greater than that of said lower gap but less than that of said upper gap.

6. The apparatus defined in claim 1, claim 3 or claim 5 wherein said upper edge is disposed above the axis of said roller.

7. An apparatus for applying a layer of a flowable substance to a workpiece, comprising:

a vessel containing a bath of said substance;

an applicator roller rotatable in said vessel and partially immersed in said bath and positioned so that said workpiece can be continuously displaced in a given direction across said roller and meets the top of said roller to receive the substance from said roller;

reversing-drive means connected to said roller for rotating said roller in one sense upon approach of said workpiece to said roller whereby the upper portion of said roller moves in said direction, and in the opposite sense thereafter whereby said upper portion of said roller rotates in a direction opposite said given direction; and a metering container at a downstream side of said roller in said given direction, said metering container having upper and lower edges defining respective gaps with said roller, the upper gap being wider than the lower gap, said container having a volume at least several times greater than the volume of said substance to be applied to said workpiece, said edges controlling the thickness of said substance applied to said roller, and said upper edge and gap being disposed above the level of the bath in said vessel.

8. A method of coating an edge of a stack of sheets with a flowable adhesive substance, comprising the steps of:

(a) moving said stack continuously along a transport path above a bath of said substance with said edge forming a horizontal lower boundary of the stack;

(b) partly immersing an applicator roller in said bath with the top of the roller lying just below the level of said lower boundary;

(c) enclosing the downstream side of said roller, as seen in the direction of stack motion, by a container which rises above the bath surface and has upper and lower edges respectively spaced from the roller periphery by a relatively wide upper clearance and a relatively narrow lower clearance;

(d) rotating said roller codirectionally with the approaching stack up to an instant when the front of the stack lies substantially above the top of the roller, thereby accumulating a quantity of said substance on the downstream side of the roller to fill said container by way of its upper clearance; and (e) reversing at said instant the rotation of said roller whereby the accumulated substance from said container adheres to said roller and substantially uniformly coats the lower boundary of the stack moving across said roller.

9. A method as defined in claim 8 wherein the reversal of roller rotation in step (e) is controlled by a switch detecting the arrival of the stack front above the top of the roller.

* * * * *